US007384274B1

(12) United States Patent
Chen et al.

(10) Patent No.: US 7,384,274 B1
(45) Date of Patent: Jun. 10, 2008

(54) BOARD TO BOARD CONNECTOR

(75) Inventors: Chung-Yu Chen, Taipei Hsien (TW); Mei-Chuan Yang, Taipei Hsien (TW); Chung-Hsin Huang, Taipei Hsien (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 11/833,850

(22) Filed: Aug. 3, 2007

(51) Int. Cl.
*H01R 12/00* (2006.01)

(52) U.S. Cl. ..... 439/74

(58) Field of Classification Search ..... 439/74, 439/660, 295, 284, 83, 66, 247, 65, 876, 439/95, 931, 342, 884, 70–71, 563, 733.1
See application file for complete search history.

(56) References Cited

U.S. PATENT DOCUMENTS 7,195,495 B2 * 3/2007 Takano et al. ..... 439/74
7,320,605 B2 * 1/2008 Chang et al. ..... 439/74
7,320,606 B2 * 1/2008 Midorikawa ..... 439/74

* cited by examiner

*Primary Examiner*—Edwin A. León
(74) *Attorney, Agent, or Firm*—WPAT, P.C.; Anthony King

(57) ABSTRACT

A board to board connector includes a plug and a receptacle. The two ends of the receptacle sink to form a U-shape groove. The groove penetrates downward through the first housing of the receptacle and can accept a first locking piece. The first locking piece has a U-shaped body received in the groove, which extends to form welding portions, and the welding portions project out of the first housing. An inserting groove is opened in the end of the plug. The inserting groove can accept a second locking piece. A straight arm of the second locking piece projects out of the second housing of the plug. The board to board connector can be welded in PCBs by the first and second locking pieces.

7 Claims, 6 Drawing Sheets

BOARD TO BOARD CONNECTOR

BACKGROUND OF THE INVENTION

1. Field of the Invention

This present invention relates to a board to board connector, and more specifically to a board to board connector which can be welded firmly on PCBs.

2. The Related Art

Conventionally, a board to board connector is arranged in an electric product to deliver signals between two PCBs.

A traditional board to board connector includes a receptacle and a plug. The receptacle and the plug are respectively welded on PCBs via a plurality of conductive terminals located in the receptacle and the plug. While the plug connector is inserted into the receptacle, the two PCBs can deliver signals therebetween.

As the volume of electric products is reduced, the conductive terminals are reduced correspondingly. It means that a welding portion of the conductive terminal is difficult to be welded on the PCB, because the area of the welding portion is too small. Particularly, the plug connector is inserted into or removed from the receptacle connector many times, the welding portion of the conductive terminal is easy to depart from the PCB.

SUMMARY OF THE INVENTION

An object of the invention is to provide a board to board connector comprising a receptacle and a plug inserted into the receptacle. The receptacle includes a first housing, a plurality of first terminals and first locking piece. The first housing has a first side wall and a second side wall, the first and second side walls are symmetrical arranged in the first housing. The top of the second side wall defines a groove, the groove extends to the first side walls and then extends towards the middle of the first side walls to show a U-shape. The bottom of the groove defines two first receiving holes penetrating downward through the first side walls respectively and two second receiving holes penetrating downward through the second side wall. The first locking piece has a U-shape body, the first locking piece is arranged in the groove. The two ends and the middle of the body extend downward to form at least one welding portion respectively. The welding portions are inserted into the first receiving hole and the second receiving hole, the bottom of the welding portions projects out of the first housing. The plug has a second housing, a plurality of second terminals received in the second housing and a pair of second locking pieces. The second housing has two first wallboards and two second wallboards, an inserting groove is opened in the bottom surface of the second wallboard. The fundus of the inserting groove defines at least one inserting hole through the second wallboard. The second locking piece has a horizontal arm and at least one straight arm vertically extending from the horizontal arm. The second locking piece is inserted into the inserting groove, the straight arm is arranged in the inserting hole, and the top of the straight arm projecting out of the second housing.

As above description, the board to board connector can be welded on PCBs by the first and second locking pieces. While the plug is inserted into or pulled out from the receptacle many times, the board to board connector can combined with the PCBs firmly, and the first and second locking pieces can easily assembled in the board to board connector.

BRIEF DESCRIPTION OF THE DRAWINGS

The invention, together with its objects and the advantages thereof may be best understood by reference to the following description taken in conjunction with the accompanying drawings, in which.

DETAILED DESCRIPTION OF THE PREFERRED EMBODIMENT

Figure 1:
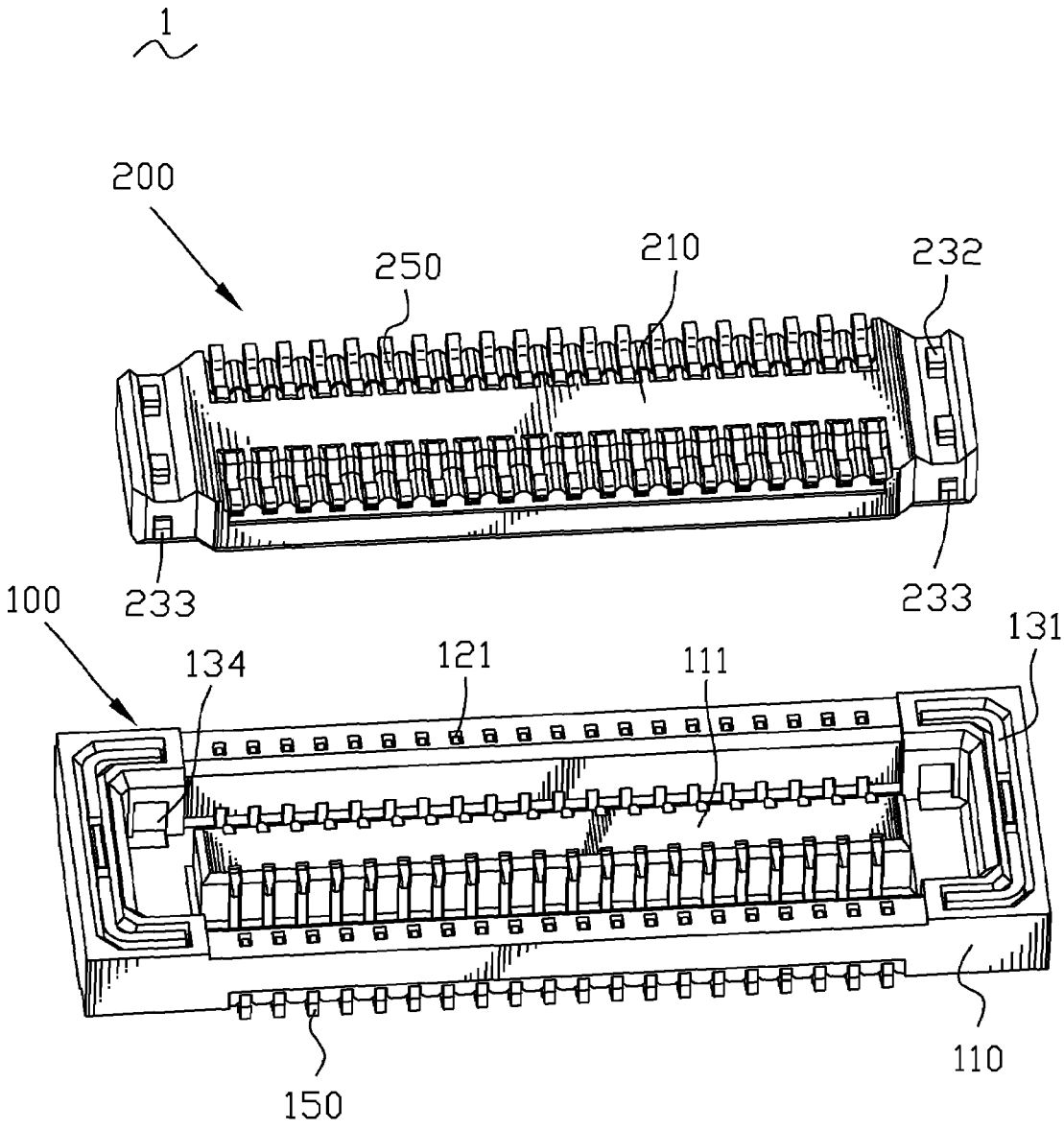
FIG. 1 is an exploded perspective view of a board to board connector according to the present invention.

First referring to FIG. 1, a board to board connector 1 according to the invention is shown. The board to board connector 1 comprises a receptacle 100 and a plug 200 connected with the receptacle 100. The receptacle 100 and the plug 200 are respectively fixed on two PCBs (not shown). While the plug 200 is inserted into the receptacle 100, the two PCBs can deliver signal to each other.

Figure 2:
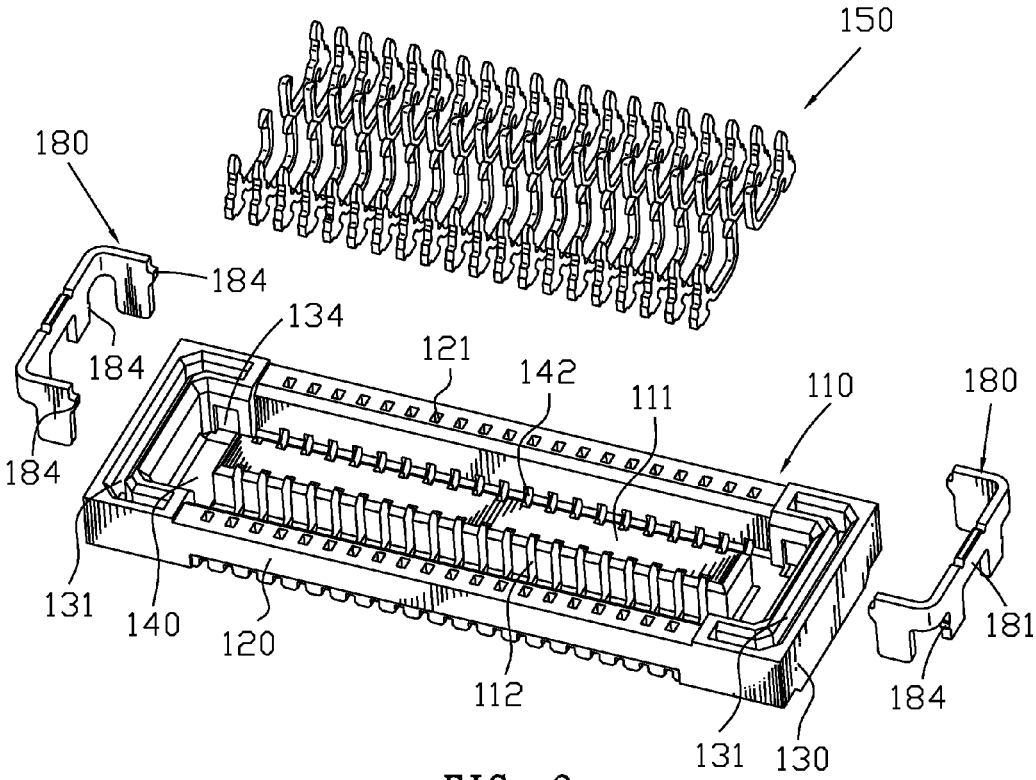
FIG. 2 is an exploded perspective view of a receptacle of the board to board connector shown in FIG. 1.
Figure 3:
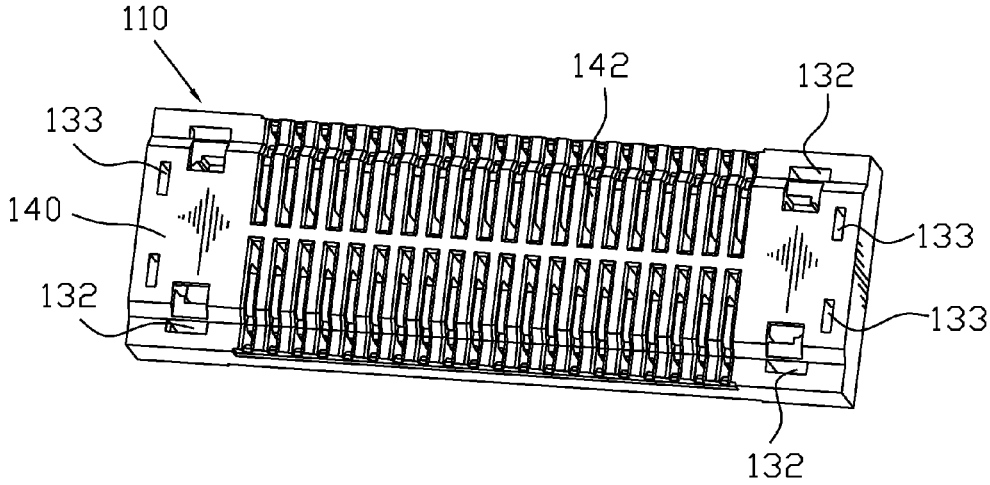
FIG. 3 is a perspective view of a first housing of the receptacle.

Please refer to FIGS. 1-3, the receptacle 100 includes a first housing 110, a plurality first terminals 150 received in the first housing 110, and a pair of first locking pieces 180 inserted in two ends of the first housing 110.

The first housing 110 has a base 140 showing a rectangular board shape. Two first side walls 120 project from two long edges of the base 140, two second side walls 130 project from two short edges of the base 140. The second side walls 130 are slightly taller than the first side walls 120. A projection 111 projects from the middle of the base 140 and is surrounded by the first side walls 120 and the second side walls 130. The projection 111 parallels the first side walls 120, the height of the projection 111 is lower than the height of the first side wall 120. The projection 111, the first side walls 120 and the second side walls 130 define a circular receiving room to receive the plug 200. A plurality of first terminal holes 121 are opened in the first side walls 120 and penetrate downward through the first side walls 120. A plurality of first terminal receiving passageways 142 are opened in the base 140 and connect the first terminal holes 121. A plurality of supplementary grooves 112 are opened in the side surfaces of the projection 111 and connect the first terminal receiving passageways 142. The supplementary groove 112, the first terminal hole 121 and the first terminal receiving passageway 142 define a first passage to receive the first terminal 150. Two rectangle grooves 134 are opened in the two ends of the inner side of the first side wall 120. The top of the second side wall 130 defines a groove 131, the groove 131 extends to the two first side walls 120 and then extends towards the middle of the first side walls 130 to show a U-shape. The bottom of the groove 131 defines two first receiving holes 132 penetrating downward through the first side walls 120 respectively and two second receiving holes 133 penetrating downward through the second side wall 130.

Figure 4:
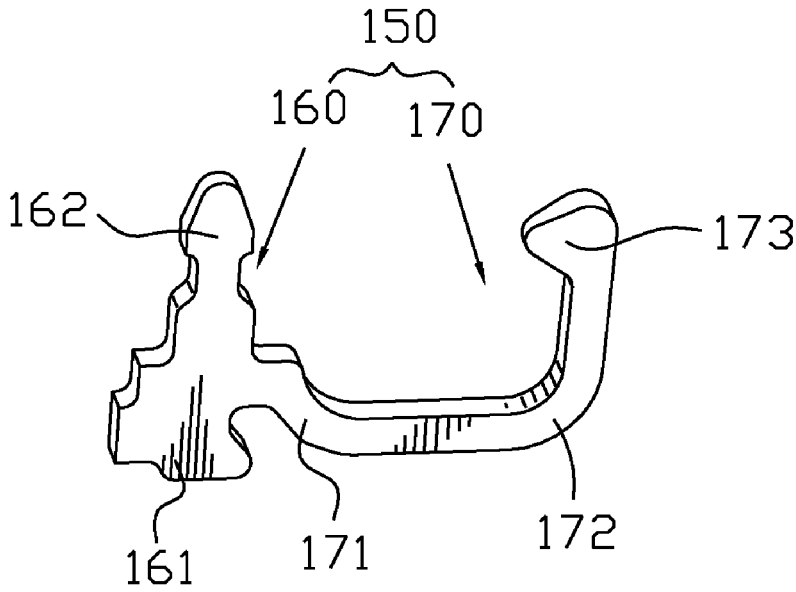
FIG. 4 is a perspective view showing a first terminal of the receptacle.

Referring to FIG. 4, the first terminals 150 are made by cutting a metal board. The first terminal 150 has a rising portion 160 and a bending portion 170 crookedly extending from one side of the rising portion 160. The bottom end of the rising portion 160 has a first soldering portion 161 to weld in a PCB. The top end of the rising portion 160 forms a head 162 showing an arrow shape. The bending portion 170 has a first bending portion 171 and a second bending portion 172. The first bending portion 171 crookedly extends from one side of the rising portion 160. The second bending portion 172 horizontally extends from the end of the first bending portion 171 and then bends upward to equal the head 162 of the rising portion 160. A triangle hook 173 projects from the end of the second bending portion 172 and points the rising portion 160.

Figure 5:
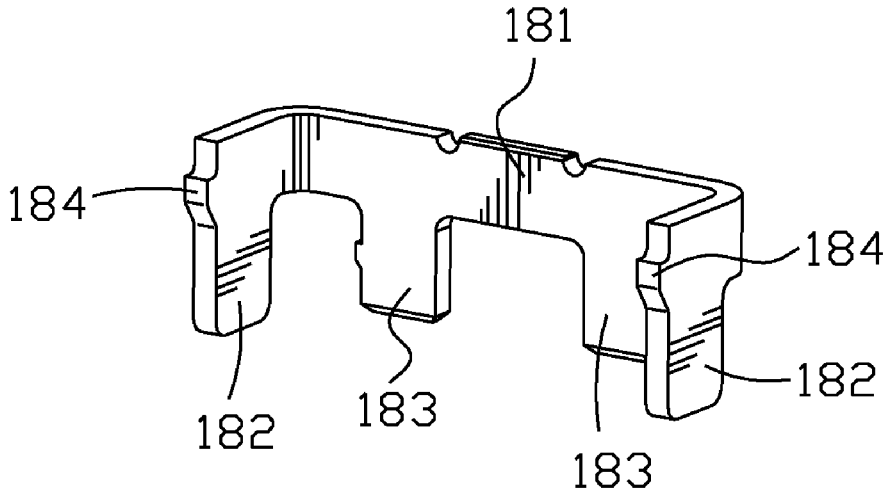
FIG. 5 is a perspective view of a first locking piece of the receptacle.

Please refer to FIGS. 2 and 5, the first locking piece 180 is also made by cutting a metal board. The first locking piece 180 has a U-shape body 181 according to the groove 131 of the first housing 110. The two sides of the body 181 extend downward to form two first welding portions 182. Two second welding portions 183 are symmetrically arranged in the middle of the body 181. The first welding portions 182 and the second welding portions 183 have salient points 184.

Figure 11:
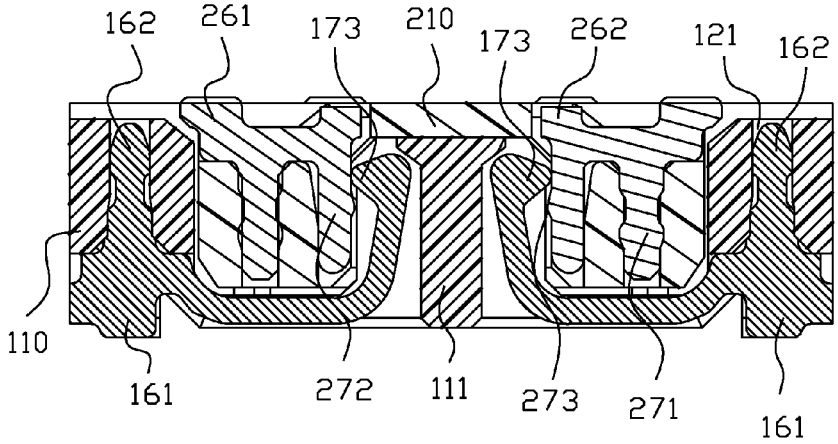
FIG. 11 is a cross-sectional view of FIG. 10.

Referring to FIGS. 1 and 11, while the receptacle 100 is assembled, the first terminals 150 are inserted into the first passages from bottom to top. The rising portion 160 of the first terminal 150 is accepted in the first terminal hole 121 of the first side wall 120, the head 162 of the rising portion 160 is located in the top of the first terminal hole 121, the first soldering portion 161 projects out from the bottom of the first housing 110 and is soldered to the corresponding PCB. The bending portion 170 of the first terminal 150 is accepted in the first terminal receiving passageway 142 and the supplementary groove 112. The triangle hook 173 projects out of the supplementary groove 112. The first locking piece 180 is inserted into the groove 131 from top to bottom. The first welding portion 182 is inserted into the first receiving hole 132 and projects out from the bottom of the first housing 110. The second welding portion 183 is inserted into the second receiving hole 133 and projects out from the bottom of the first housing 110. The first and second welding portions 182, 183 can fix the receptacle 100 in the PCB.

Figure 6:
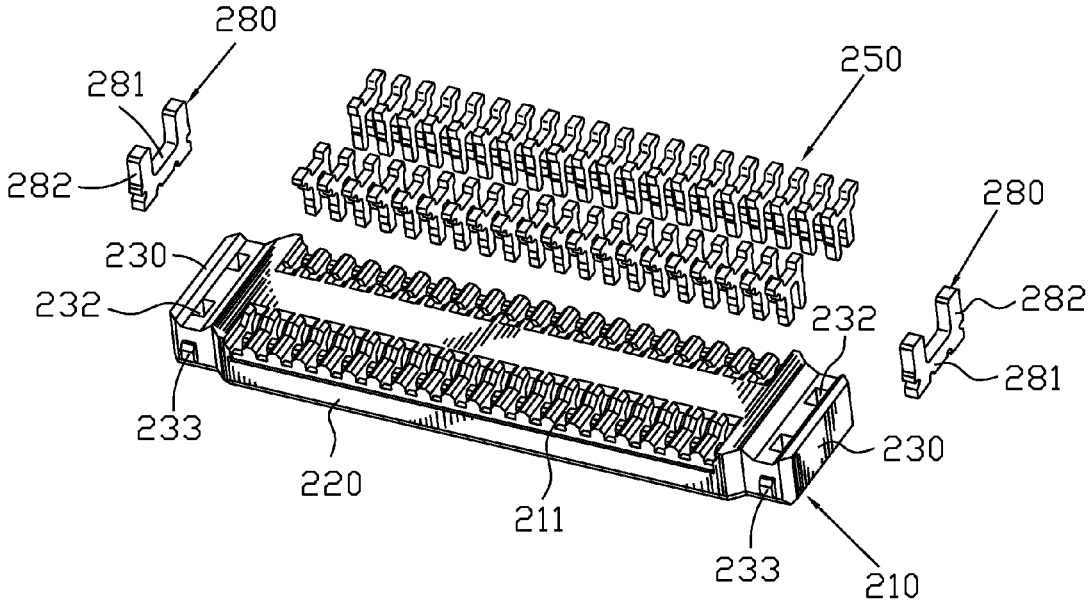
FIG. 6 is an exploded perspective view of a plug of the board to board connector shown in FIG. 1.
Figure 7:
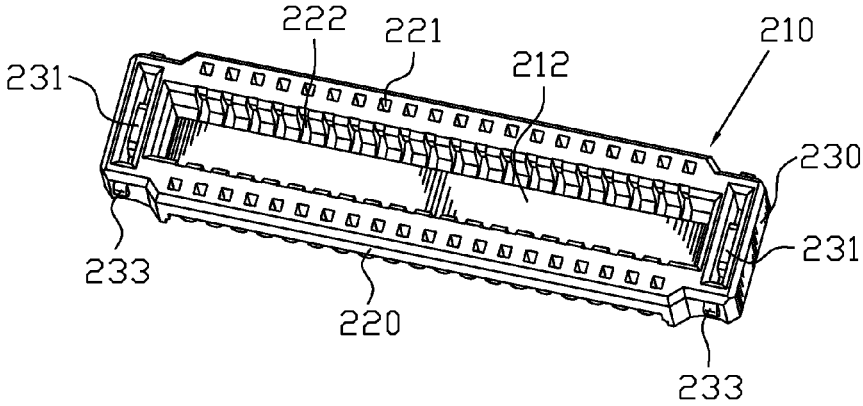
FIG. 7 is a perspective view of a second housing of the plug.

Referring to FIGS. 1, 6 and 7, the plug 200 includes a second housing 210, a plurality of second terminals 250 accepted in the second housing 210, and two second locking pieces 280 inserted into the second housing 210.

The second housing 210 has a main body showing a rectangular board shape, the middle of the top surface of the main body is higher than the top surfaces of the two ends of the main body. Two rows of receiving grooves 211 are opened in the top surface of the main body. An inserting space 212 is opened in the middle of the bottom surface of the main body, so two long first wallboards 220 and two short second wallboards 230 are formed in the second housing 210. The inserting space 212 can receive the projection 111 of the receptacle 100 exactly. A plurality of second terminal holes 221 are opened through the first wallboard 220 from top to bottom. A plurality of second terminal receiving passageways 222 are opened in the inside of the first wallboard 220 and connect the inserting space 212, the second terminal receiving passageway 222 accords to the second terminal hole 221. The second terminal receiving passageway 222, the second terminal hole 221 and the receiving groove 211 define a second passage to receive the second terminal 250. An inserting groove 231 is opened in the bottom of the second wallboard 230. The two ends of the fundus of the inserting groove 231 define two inserting holes 232 through the second wallboard 230. The inserting groove 231 and the inserting holes 232 are used to accept the second locking piece 280. Two protrudent lumps 233 are symmetrically arranged in the outside of the second wallboard 230.

Figure 8:
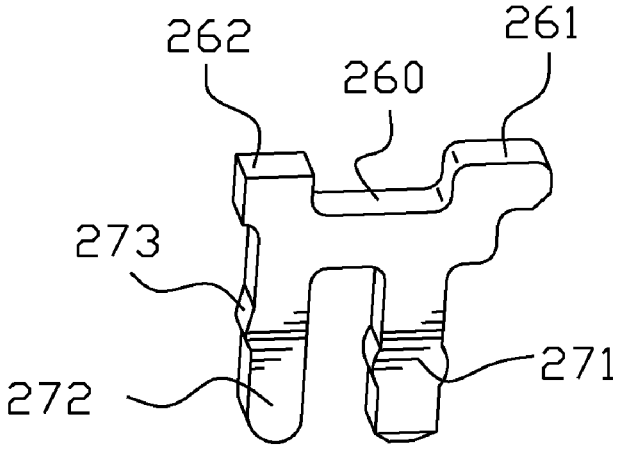
FIG. 8 is a perspective view of a second terminal of the plug.

Please refer to FIG. 8, the second terminals 250 are made by cutting a metal board. The second terminal 250 has a horizontal bar 260, a first insertion portion 271 and a second insertion portion 272 downward extending from the two ends of the horizontal bar 260. One end of the horizontal bar 260 projects upward and then extends horizontally to form a second soldering portion 261, the other end of the horizontal bar 260 projects upward and then extends horizontally to form a projection end 262. The height of the projection end 262 is slightly lower than the second soldering portion 261. Two sides of the middle of the first insertion portion 271 and one side of the middle of the second insertion portion 272 projects outward to form a projecting portion 273 respectively.

Figure 9:
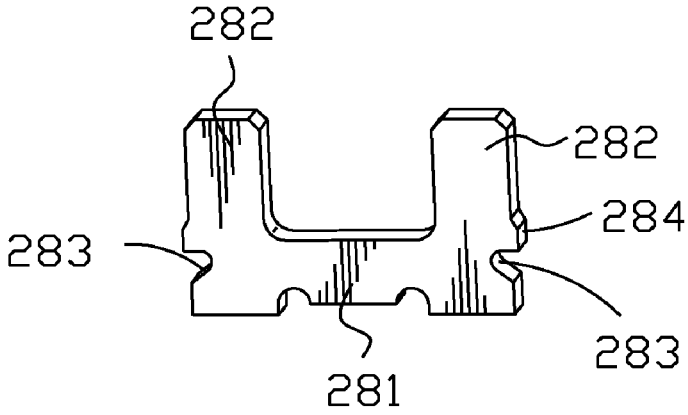
FIG. 9 is a perspective view of a second locking piece of the plug.

Refer to FIG. 9, the second locking piece 280 has a U shape. The second locking piece 280 has a horizontal arm 281 and two straight arms 282 upward extending from two ends of the horizontal arm 281. Two hollows 283 are symmetrically opened in the outsides of the straight arms 282. A projection piece 284 is projected from the top of the hollow 283.

Please refer to FIGS. 1 and 11, while the plug 200 is assembled, the second terminals 250 are inserted into the second passages from top to bottom. The horizontal bar 260 is accepted in the receiving groove 211. The first insertion portion 271 is inserted into the second terminal hole 221, the projecting portion 273 is against the side wall of the second terminal hole 221. The second insertion portion 272 is inserted into the second terminal receiving passageway 222. The second soldering portion 261 protrudes out of the top surface of the second housing 210 and can be welded to the corresponding PCB. The second locking piece 280 is inserted into the inserting groove 231 opened in the second wallboard 230 from top to bottom. The projection pieces 284 are against the inner wall of the inserting groove 231. The two straight arms 282 are inserted into the two inserting holes 232 and extend out of the top surface of the second wallboard 230 for being welded on the PCB.

Figure 10:
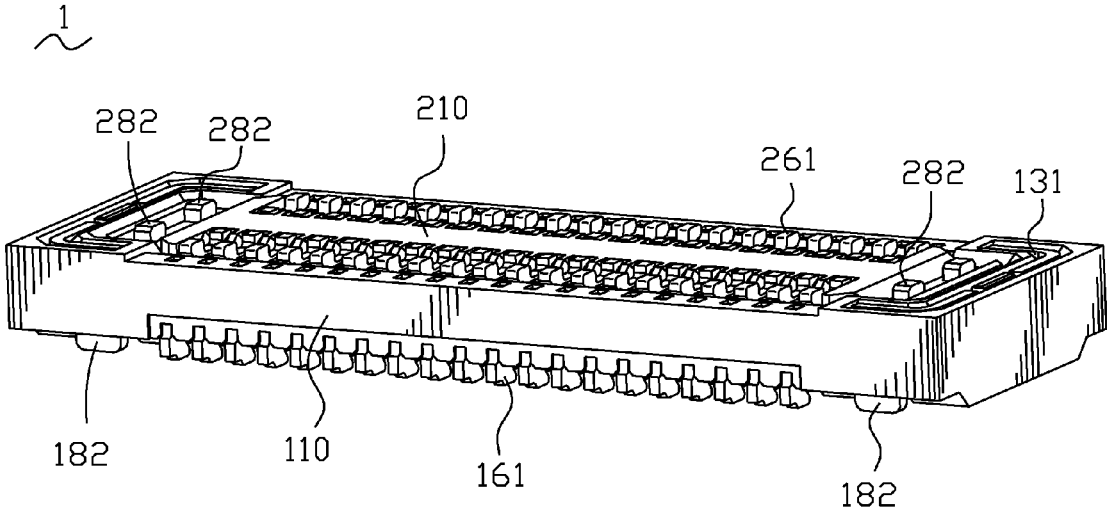
FIG. 10 is an assembled view of the board to board connector.

Refer to FIGS. 1, 10 and 11, while the plug 200 is inserted into the receptacle 100, the inserting space 212 of the plug 200 matches with the projection 111 of the receptacle 100, the protrudent lumps 233 formed in the ends of the plug 200 are accepted in the hollows 134 of the receptacle 100, so the plug 200 and the receptacle 100 are fasten together. The triangle hook 173 of the first terminal 150 is located between the projecting portion 273 and the projection end 262 of the second terminal 250, so the plug 200 can be fasten in the receptacle 200 firmly.

While the board to board connector 1 is welded to the PCBs, the first soldering portion 161 of the first terminal 150 and the second soldering portion 261 of the second terminal 250 are soldered in the corresponding PCBs, and the first locking piece 180 and the second locking piece 280 fasten the board to board connector 1 on the PCBs firmly. The first welding portion 182 and the second welding portion 183 of the first locking piece 180 extend out of the bottom of the receptacle 100 and weld with a PCB, so the receptacle 100 is fasten firmly in the PCB. The two straight arms 282 of the second locking piece 280 extend out of the top surface of the plug 200 and is welded to the PCB, so the plug 200 is fasten firmly in the PCB.

As above description, the board to board connector 1 can be welded on the PCBs by the first and second locking pieces 180 and 280, while the plug 200 is inserted into or pulled out from the receptacle 100 many times, the board to board connector 1 can combined with the PCBs firmly, and the first and second locking pieces 180, 280 can easily assembled in the board to board connector 1.

An embodiment of the present invention has been discussed in detail. However, this embodiment is merely a specific example for clarifying the technical contents of the present invention and the present invention is not to be construed in a restricted sense as limited to this specific example. Thus, the spirit and scope of the present invention are limited only by the appended claims.

What is claimed is:

1. A board to board connector, comprising:

a receptacle having a first housing, a plurality first terminals received in the first housing, and a pair of first locking pieces, the first housing having two first side walls and two second side walls, the top surface of the second side wall defines a groove, the groove extending to the two first side walls and then extending towards the middle of the first side walls to show a U-shape, the bottom of the groove defining at least two first receiving holes penetrating downward through the first side walls respectively and at least one second receiving hole penetrating downward through the second side wall, the first locking piece having a U-shape body received in the groove, the two ends and the middle of the body extending downward to form welding portions respectively, the welding portions inserted into the first receiving holes and the second receiving hole, the bottom of the welding portions projecting out of the first housing; and a plug inserted into the receptacle, the plug having a second housing, a plurality of second terminals received in the second housing and a pair of second locking pieces, the second housing having two first wallboards and two second wallboards, an inserting groove opened in the bottom surface of the second wallboard, the fundus of the inserting groove defining at least one inserting hole through the second wallboard, the second locking piece having a horizontal arm and at least one straight arm vertically extending from the horizontal arm, the second locking piece inserted into the inserting groove, the straight arm arranged in the inserting hole, and the top of the straight arm projecting out of the second housing.

2. The board to board connector as set forth in claim 1, wherein the second receiving hole opened in the two ends of the second side walls respectively, the middle of the body of the first locking piece extends downward to form two said welding portions.

3. The board to board connector as set forth in claim 1, wherein the welding portions of the first locking piece projects outward to form salient points.

4. The board to board connector as set forth in claim 1, wherein the two ends of the horizontal arm vertically extend to form two said straight arms.

5. The board to board connector as set forth in claim 4, wherein the outside of each straight arm defines a hollow, a projection piece projects from the top of the hollow.

6. The board to board connector as set forth in claim 1, wherein the second terminal has a horizontal bar, a first insertion portion and a second insertion portion downward extends from two ends of the horizontal bar, one end of the horizontal bar projects upward and then extends horizontally to form a projection end, the middle of the second insertion portion projects outward to form a projecting portion, the first terminal has a rising portion and a bending portion crookedly extending from one side of the rising portion, a triangle hook projecting from the end of the bending portion is located between the projecting portion and the projection end of the second terminal.

7. The board to board connector as set forth in claim 6, wherein the end of the rising portion of the first terminal has a first soldering portion, the top end of the rising portion forms a head showing an arrow shape, the bending portion of the first terminal has a first bending portion and a second bending portion, the first bending portion crookedly extends from one side of the rising portion, the second bending portion horizontally extends from the end of the first bending portion and then bend upward to equal the head of the rising portion, the triangle hook projects from the end of the second bending portion.

* * * * *